US011111744B2

(12) United States Patent
Boyd

(10) Patent No.: US 11,111,744 B2
(45) Date of Patent: Sep. 7, 2021

(54) METHODS AND SYSTEMS FOR MOUNTING A ZIPPER MANIFOLD INCLUDING RAILS

(71) Applicant: COMMANDO PRESSURE CONTROL LLC, Kingwood, TX (US)

(72) Inventor: Joseph Mark Boyd, Houston, TX (US)

(73) Assignee: Commando Pressure Control, Inc., Houston, TX (US)

( * ) Notice: Subject to any disclaimer, the term of this patent is extended or adjusted under 35 U.S.C. 154(b) by 0 days.

(21) Appl. No.: 16/811,297

(22) Filed: Mar. 6, 2020

(65) Prior Publication Data

US 2020/0284110 A1 Sep. 10, 2020

Related U.S. Application Data

(60) Provisional application No. 62/814,956, filed on Mar. 7, 2019.

(51) Int. Cl.

| | |
|---|---|
| ***E21B 21/10*** | (2006.01) |
| ***E21B 21/01*** | (2006.01) |
| ***E21B 21/06*** | (2006.01) |
| ***E21B 34/16*** | (2006.01) |
| ***E21B 43/26*** | (2006.01) |

(52) U.S. Cl.

CPC ..... *E21B 21/106* (2013.01); *E21B 21/01* (2013.01); *E21B 21/062* (2013.01); *E21B 34/16* (2013.01); *E21B 43/26* (2013.01)

(58) Field of Classification Search

CPC ..... E21B 21/01; E21B 21/062; E21B 21/106; E21B 34/16; E21B 43/26; E21B 43/2607; E21B 43/2605

See application file for complete search history.

(56) References Cited

U.S. PATENT DOCUMENTS

| | | | | |
|---|---|---|---|---|
| 2009/0095465 | A1* | 4/2009 | Vickery | E21B 33/03 166/79.1 |
| 2017/0122060 | A1* | 5/2017 | Dille | B60P 3/2205 |
| 2017/0370199 | A1* | 12/2017 | Witkowski | F16K 31/126 |
| 2018/0187662 | A1* | 7/2018 | Hill | E21B 43/26 |
| 2018/0237047 | A1* | 8/2018 | Tolles | B62B 3/04 |
| 2018/0284816 | A1* | 10/2018 | Cook | G05D 7/0664 |
| 2020/0109616 | A1* | 4/2020 | Oehring | B01D 46/003 |
| 2020/0131877 | A1* | 4/2020 | Guidry | E21B 43/26 |

FOREIGN PATENT DOCUMENTS

| | | | | |
|---|---|---|---|---|
| WO | WO-2007014143 | A2 * | 2/2007 | B60P 3/14 |

* cited by examiner

*Primary Examiner* — James G Sayre
(74) *Attorney, Agent, or Firm* — Pierson IP, PLLC

(57) ABSTRACT

A mounting system for zipper manifold that includes rails. Embodiments may include mixing block and injection head modules that are configured to move on a trailer.

18 Claims, 16 Drawing Sheets

METHODS AND SYSTEMS FOR MOUNTING A ZIPPER MANIFOLD INCLUDING RAILS

BACKGROUND INFORMATION

Field of the Disclosure

Examples of the present disclosure relate to methods and systems for a railing network configured to move a mounted zipper manifold. Embodiments may include mixing block and injection head modules that are configured to move along the railing network on a trailer.

Background

A zipper manifold is a system of frac valves that directs treatment fluid to multiple outlets. Zipper manifolds provide a quick redirection of fracturing pressure from one well to another, enabling pump trucks to run more efficiently to minimize downtime. Zipper manifolds also isolate wells from flow and pressure by opening and closing associated valves. When a stage is completed, the valves associated with the completed stage may be closed, and valves associated with the next valve may be opened.

However, zipper manifolds consists of valves and other pressure containing assets that are large and heavy. This creates hazards and inefficiencies when dealing repositioning, assembling, and disassembling of the elements associated with the zipper manifolds.

Accordingly, needs exist for system and methods utilizing mixing block and injection head modules that are configured to be moved on a rail system while positioned on a trailer.

SUMMARY

Embodiments disclosed herein describe a modular, self-contained, integrated, collapsible trailer mounted zipper manifold system. The system may be formed of a series of rails that are configured to independently and selectively move injection head modules, mixing blocks, and valve assemblies. In embodiments, the injection head modules, mixing blocks, and valve assemblies may utilize a main rail that extends along the length of a trailer. The injection head modules, mixing blocks, and valve assemblies may also utilize secondary rails.

In embodiments, a mixing block and valve assemblies may be configured to be positioned on a first cart, wherein the first cart is coupled to the main rail and a secondary rail. The first cart may include a mixing block cart configured to secure the mixing block in place, and a valve tray that is configured to secure the valve assemblies in place. The valve tray may be configured to extend and be retracted in a direction that is perpendicular to the length of the trailer, and also perpendicular to the first and secondary rail. By extending and retracting the valve tray, the valve assemblies may move away from the mixing block to be replaced, and the replacement valve assemblies may be moved adjacent to outlets on the mixing block.

In embodiments, a first injection head module may be positioned on a second cart, wherein the second cart is coupled to the main rail and a secondary, upper rail. The second cart, main rail, and secondary upper rail may be configured to allow the independent movement of the first injection head module from the mixing block.

In embodiments, a second injection head module may be positioned on a third cart, wherein the third cart is coupled to the main rail and a secondary, lower rail. The third cart, main rail, and secondary lowerrail may be configured to allow independent movement of the second injection head module from the mixing block.

Embodiments may also include an integrated housing. The integrated housing may be configured to be positioned along a central axis of a trailer between the secondary upper and lower rails. The integrated housing may be configured to house hard lines, hosing, and wiring for automation systems and greasing systems. The integrated housing may be coupled with quick-connect boards that are associated with a valve assembly or a series of valves.

In embodiments, a decking system configured to be positioned over the main rail, the decking system may include a plurality of removable panels, wherein each of the removable panels may be independently removed.

In embodiments, a crane system may be positioned over the rails. The crane system may be configured to allow a crane to move above the decking system along a longitudinal and latitudinal path.

These, and other, aspects of the invention will be better appreciated and understood when considered in conjunction with the following description and the accompanying drawings. The following description, while indicating various embodiments of the invention and numerous specific details thereof, is given by way of illustration and not of limitation. Many substitutions, modifications, additions or rearrangements may be made within the scope of the invention, and the invention includes all such substitutions, modifications, additions or rearrangements.

BRIEF DESCRIPTION OF THE DRAWINGS

Non-limiting and non-exhaustive embodiments of the present invention are described with reference to the following figures, wherein like reference numerals refer to like parts throughout the various views unless otherwise specified.

Figure 1:
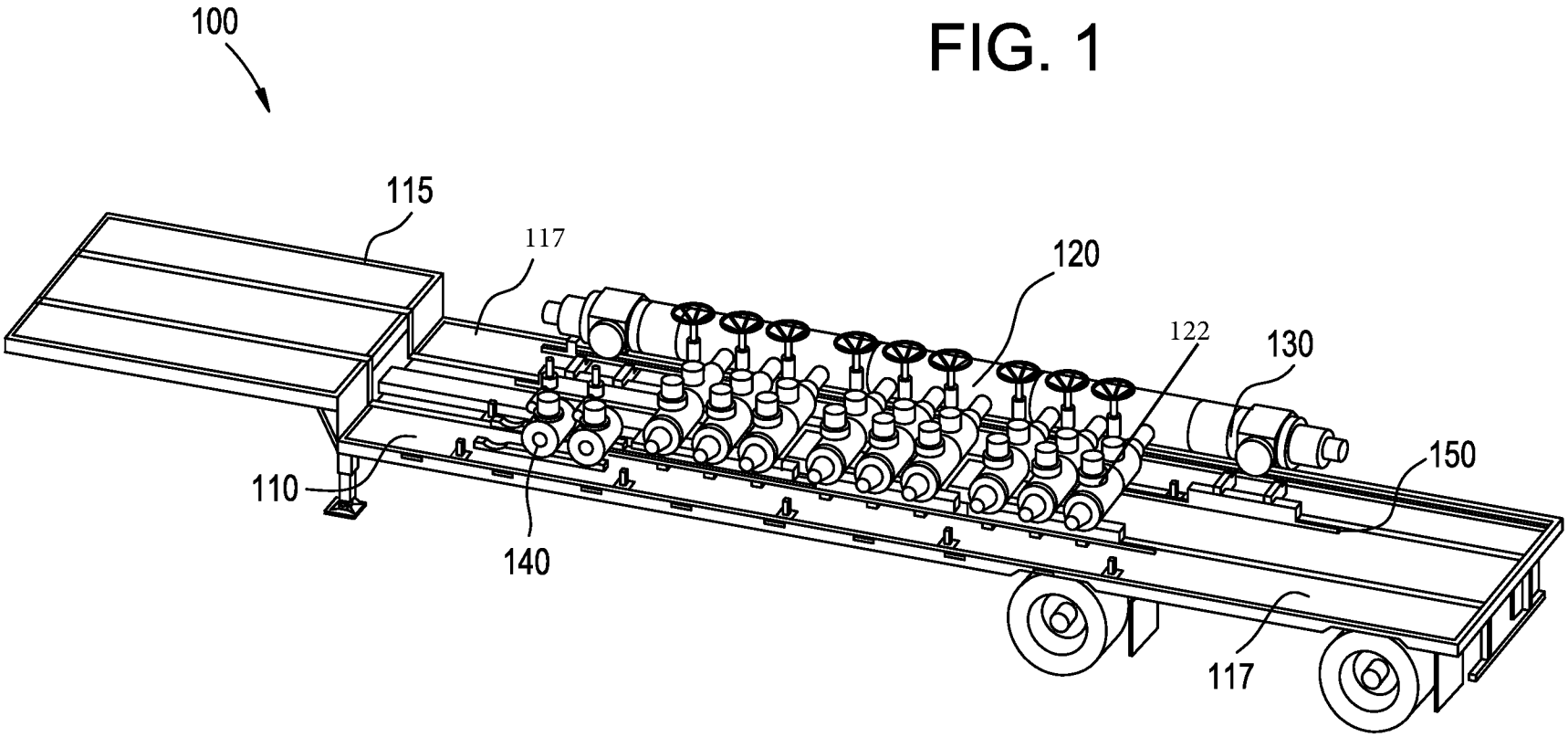
FIG. 1 depicts a system for a trailer mounter zipper manifold, according to an embodiment.

Corresponding reference characters indicate corresponding components throughout the several views of the drawings. Skilled artisans will appreciate that elements in the figures are illustrated for simplicity and clarity and have not necessarily been drawn to scale. For example, the dimensions of some of the elements in the figures may be exaggerated relative to other elements to help improve understanding of various embodiments of the present disclosure. Also, common but well-understood elements that are useful or necessary in a commercially feasible embodiment are often not depicted in order to facilitate a less obstructed view of these various embodiments of the present disclosure.

DETAILED DESCRIPTION

In the following description, numerous specific details are set forth in order to provide a thorough understanding of the present invention. It will be apparent, however, to one having ordinary skill in the art that the specific detail need not be employed to practice the present invention. In other instances, well-known materials or methods have not been described in detail in order to avoid obscuring the present invention.

Embodiments described herein utilize a zipper manifold to conduct zipper frac operations. This may allow one well to be fluidly connected to a pressure pumping system. The zipper manifold may receive the fluid and pressure to fracture a specific stage of the well. Meanwhile, the other wells that are fluidly connected to the zipper manifold may be isolated from the flow and pressure by having closed valves. When a first stage is completed, the associated valves may be closed or opened to allow flow and pressure to a second stage, and the other stages may be isolated.

FIG. 1 depicts a system 100 for a trailer mounter zipper manifold, according to an embodiment. System 100 may include a trailer 110, mixing block 120, injection module 130, backup valve assemblies 140, and rail system 150.

Trailer 110 may be an unpowered vehicle towed by a power vehicle. Trailer 110 may include a plurality of wheels, allowing trailer 110 to be towed. Trailer 110 may include an upper platform 115 and a lower platform 117, wherein lower platform 117 is positioned closer to a ground surface than upper platform 115.

Mixing block 120 may be a device that is configured to receive fluid from an injection module 130 and dispense fluid to a valve assembly. Mixing block 120 may have a first inlet positioned at a first end of mixing block 120, a second inlet positioned at a second end of mixing block 120. Systems may utilize a plurality of mixing blocks positioned in series, wherein a first inlet associated with a first mixing block 120 may be positioned adjacent to a second inlet associated with a second mixing block 120. Each of the plurality of mixing blocks 120 may include outlets positioned between the first end of mixing block 120 and second end of mixing block 120. In embodiments, the outlets may be positioned on a planar sidewall of mixing block 120 between the first and second side. This may enable the outlets to be fluidly connected to a wellhead for each mixing block module. In embodiments, by coupling a plurality of mixing blocks 120 in series may increase a size of a buffer chamber within the mixing block 120, as well as the number of outlets associated with the mixing blocks 120.

In embodiments, a different valve assembly 122 may be coupled to each outlet of the mixing block 120. Each valve assembly 122 may be configured to be opened and closed. Responsive to opening or closing a valve associated with a valve assembly 122, fluid may flow or be restricted across the valve assembly 122. The fluid may flow or be restricted from an inlet of the valve assembly 122 coupled to an outlet of the mixing block 120, to an outlet of the valve assembly 122. The valve assemblies 122 may be configured to be independently coupled and decoupled from mixing block 120. This may allow for the independent replacement of valve assemblies 122 to a mixing block 120, and or parts associated with a valve assembly 122.

Mixing block 120 and the valve assemblies 122 may be configured to move along rail system 150 in a linear direction. This may assist in repositioning mixing block 120 and the valve assemblies 122 on trailer 110 or an independent platform including the rail system 150 for more optimal weight distribution and/or replacement of elements. Furthermore, mixing block 120 and the valve assemblies 122 may be configured to be decoupled from each other to independently move along rail system 150.

Backup valve assemblies 140 may be backup valve assemblies positioned on trailer 110 or platforming including a rail system 150. Backup valve assemblies 140 may be configured to replace valve assemblies coupled to mixing block 120. By having backup valve assemblies 140 located at a same location along with system 100, replacement of the valve assemblies may be more efficient with lower downtime. In embodiments, backup valve assemblies 140 may be positioned under a crane system.

Injection head module 130 may be an assembly of valves, spools, and fittings used to regulate the flow of pipes within system 100. Injection head module 130 may be configured to be coupled and decoupled from mixing block 120. A first injection head module 130 may be configured to be coupled and decoupled to the first inlet on mixing block 120, and a second injection head module 130 may be configured to be coupled and decoupled to the second inlet on mixing block 120. In embodiments, the first injection head module 130 and second injection head module 130 may be configured to be independently coupled and decoupled from mixing block 120. Furthermore, first injection head module 130 and second injection module 130 may be positioned on rail system 150, which enable first injection module 130 and second injection head module 130 to independently move on a linear axis. In embodiments, first injection head module 130 may be configured to move on the linear axis while second injection head module 130 and mixing block 120 remain stationary. Additionally, second injection head module 130 may be configured to move on the linear axis while first injection head module 130 and mixing block 120 remain stationary.

Rail system 150 may include tracks, pathways, etc. extending in a direction in parallel to a central axis of trailer 110. Rail system 150 may be configured to allow mixing block 120, valve assemblies 122, and injection modules 130 to move along the linear axis. This may assist in replacing varies components of system 100. In embodiments, rail system 150 may include a plurality of integrated rails that each utilize a main rail, wherein a first rail system utilizing the main rain and a first rail may be configured to be coupled with mixing block 120 and the valve assemblies 122, and a second rail system utilizing the main rail and upper and lower rails may be configured to be coupled with injection modules 130.

Figure 2:
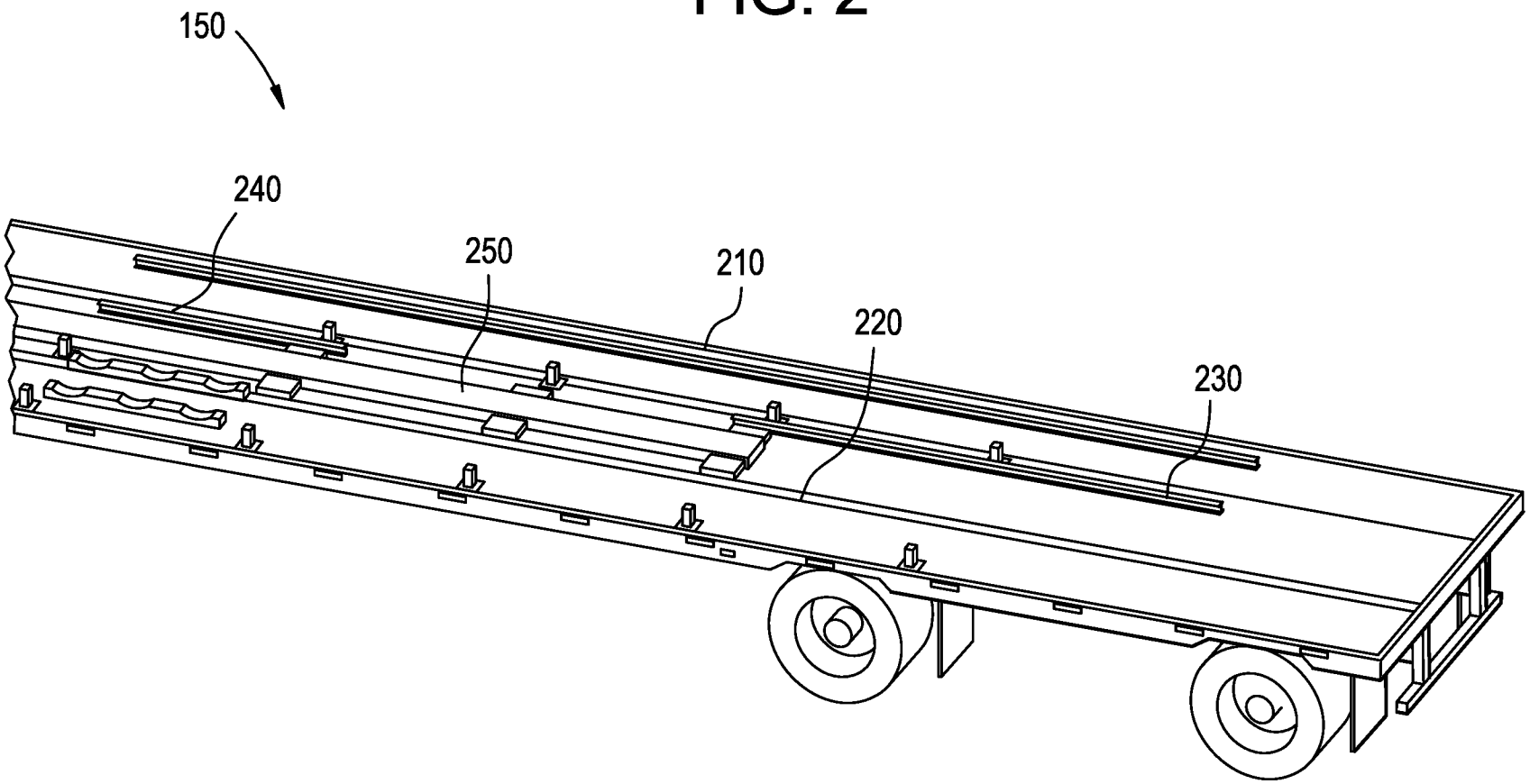
FIG. 2 depicts a rail system, according to an embodiment.

FIG. 2 depicts a rail system 150, according to an embodiment. Elements depicted in FIG. 2 may be described above, and for the sake of brevity a further description of these elements is omitted. Rail system 150 may include a main rail 210, first rail 220, lower rail 230, and upper rail 240.

Main rail 210 may be a rail that extends from a position proximal to a front end of platform 117 towards a location proximal to a rear end of platform 117. In embodiments, platform 117 may be positioned on a trailer or be an independent platform. Due to main rail 210 not extending along an entire length of platform 117, main rail 210 may assist in limiting the movement of elements positioned on main rail 210 to the front or rear end of platform 117. This may assist with weight distribution elements utilizing rail system 150. Main rail 210 may be configured to be utilized independently by mixing modules 120, first injection head module 130, and second injection head module 130.

First rail 220 may be a rail that extends from the front end of platform 117 towards the rear end of platform 117 in parallel to main rail 210. First rail 220 may be a shorter rail than main rail 210, and both of the ends of first rail 220 may be positioned between the ends of main rail 210. First rail 220 may be configured to be accessed by mixing block modules 120 and the valve assemblies 122. In embodiments, first rail 220 may be positioned between a central axis of platform 117 and a edge of platform 117, whereas main rail 210 may be positioned between the central axis of platform 117 and a second edge of platform 117.

Lower rail 230 may extend from a location proximate to a rear end of platform 117 towards a front end of platform 117 in parallel to main rail 210. In embodiments, an upper end of lower rail 230 may be positioned closer to a front end of platform 117 than the upper end of first rail 220, and the lower end of lower rail 230 may be co-planar with the lower end of main rail 210. Lower rail 230 may be utilized, along with main rail 210, to allow a first injection head module 130, positioned on a rear end of platform 117, to move in a limited linear axis. In embodiments, a first distance between lower rail 230 and main rail 210 may be less than a second distance between first rail 220 and main rail 210.

Upper rail 240 may extend from a location proximate to a front end of platform 117 towards the rear end of platform 117. Further upper rail 240 may run in parallel to main rail 210 and co-axial to lower rail 230. In embodiments, an upper end of upper rail 240 may be co-planar with the upper end of main rail 210, and a lower end of upper rail 240 may be positioned further away from a front end of platform 117 than the upper end of first rail 220. Upper rail 240 may be utilized, along with main rail 210, to allow a second injection head module 130, positioned on a front end of platform 117, to move in a limited linear axis. A length of upper rail 240 may be shorter than that of lower rail 230. In embodiments, upper rail 240 may be positioned the first distance away from main rail, wherein upper rail 240 and lower rail 230 are positioned between a central axis of trailer 110 and a second sidewall of trailer 110. The relative positioning of the rails within rail system 150 may assist in controlling the weight distribution and the center of mass of system 100.

As further depicted in FIG. 2, system 100 may include an integrated compartment 250. Integrated compartment 250 may be positioned between first rail 220 and upper rail 240 and lower rail 230. The automation controls and greasing pump/reservoir may be located on the upper platform 115. Integrated compartment 250 may be configured to house all hard lines, hosing, and wiring for grease systems and other automation systems on upper platform 115. By positioning integrated compartment 250 over a central axis of system 100, components stored with integrated compartment may assist in balancing weight across trailer 110. This may also limit hazards on trailer 110 by housing components within an integrated compartment 250.

Figure 3:
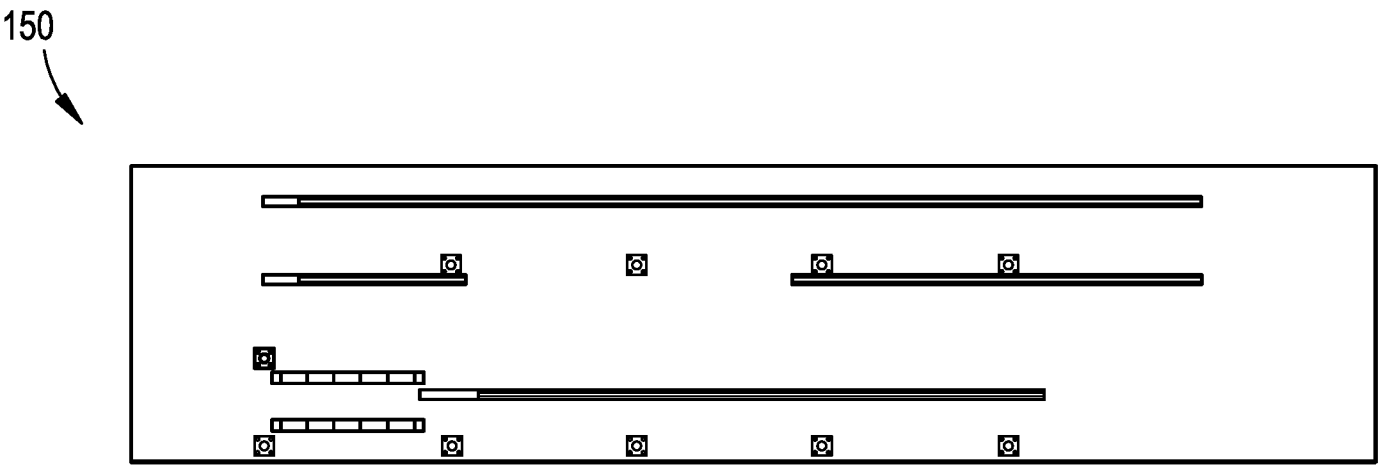
FIG. 3 depicts a rail system, according to an embodiment.

FIG. 3 depicts a rail system 150, according to an embodiment. Elements depicted in FIG. 3 may be described above, and for the sake of brevity a further description of these elements is omitted.

Based on the positioning of elements on rail system 150 on platform 117, a center of mass of the platform 117 of trailer 110.

Figure 4:
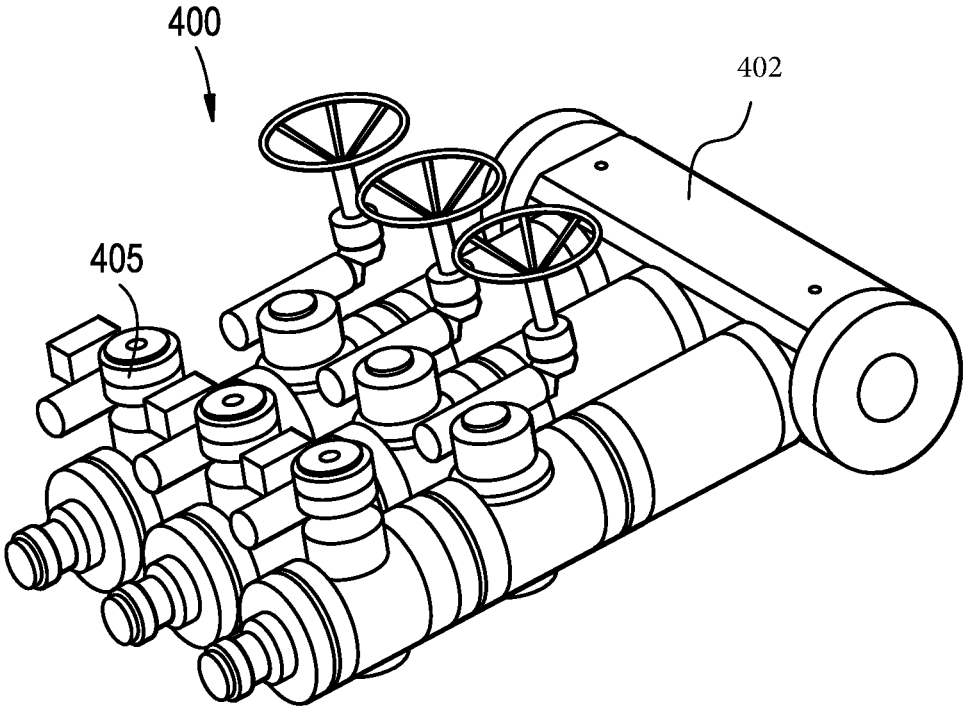
FIG. 4 depicts a mixing block module, according to an embodiment.
Figure 4:
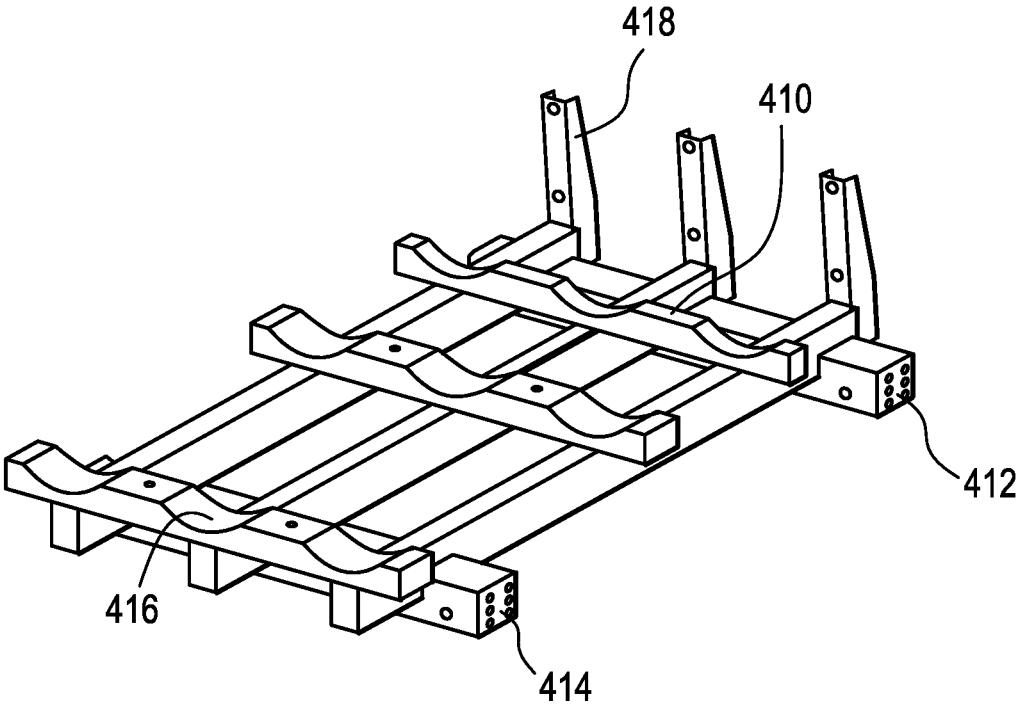

FIG. 4 depicts a mixing block module 400, according to an embodiment. Elements depicted in FIG. 4 may be described above, and for the sake of brevity a further description of these elements is omitted.

Mixing block module 400 may include mixing block 402, valve assemblies 405, and first cart 410. As depicted in FIG. 4, valve assemblies 405 may be independently coupled from mixing block 402, wherein valve assemblies 405 and mixing block 402 may be configured to be positioned on first cart 410.

First cart 410 may be configured to hold and secure mixing block 402 and valve assemblies 405 on rail system 150, while allowing for the linear movement of mixing block 402 and valve assemblies 405. First cart 410 may include a first support 412, second support 414, grooves 416, and coupling projections 418.

First support 412 may be configured to be coupled with main rail 210, and second support 414 may be configured to be coupled with first rail 220. By coupling supports 412, 414 to rails, first cart 410 may move along a linear axis.

Grooves 416 may be positioned on upper surfaces of brackets, wherein the grooves 416 are configured to receive valve assemblies 405. Grooves 416 may be configured to stabilize valve assemblies 405 while valve assemblies 405 are positioned on the brackets.

Coupling projections 418 may be positioned on a first end of first cart 410, and may extend upward. Coupling projections 418 may be configured to be positioned adjacent to a sidewall of mixing block 402, wherein coupling mechanisms may be positioned through the coupling projections 418 and mixing block 402 to couple them together.

Figure 5:
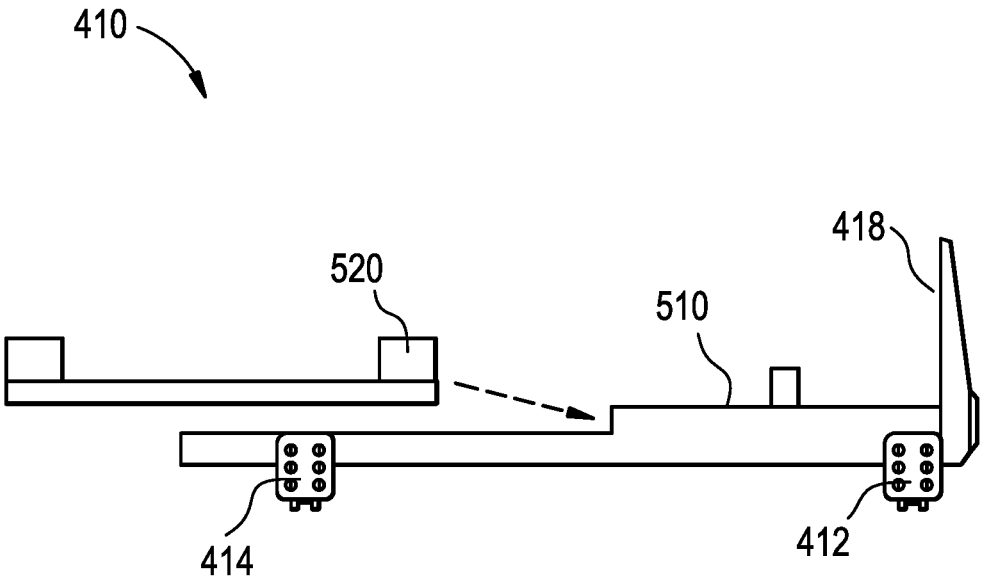
FIGS. 5-6 depict a side view of first cart, according to an embodiment.
Figure 6:
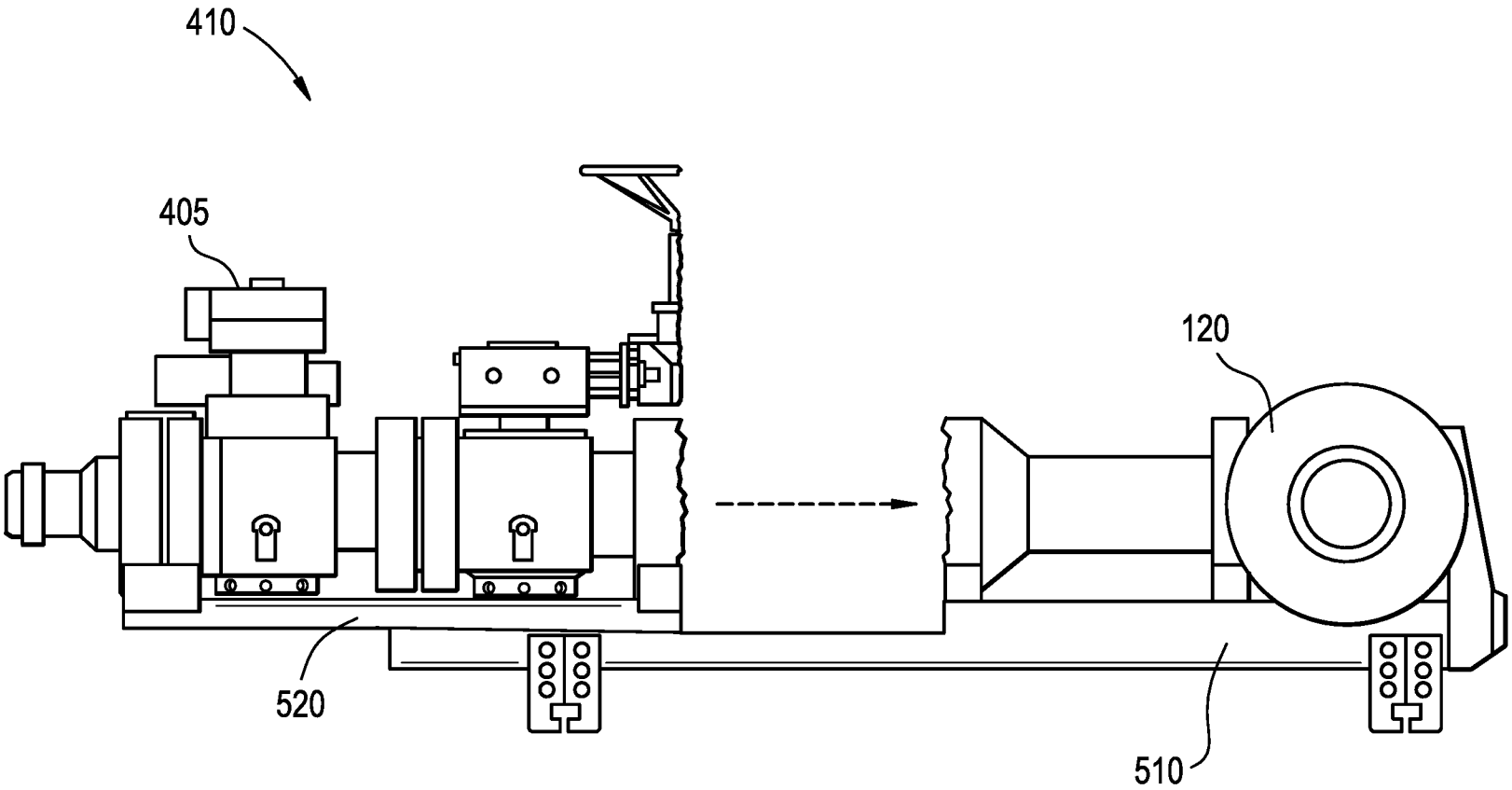

FIGS. 5-6 depict a side view of first cart 410, according to an embodiment. Elements depicted in FIGS. 5 and 6 may be described above. For the sake of brevity a further description of these elements is omitted.

As depicted in FIGS. 5 and 6, first cart 410 may include a mixing block cart 510 and valve tray cart 520. Valve tray cart 520 may be configured to move along a linear axis in a direction that is perpendicular to a central axis of platform 117 and rail system 150. This may enable valve tray cart 520 to be moved towards a sidewall of platform 117 responsive to decoupling a mixing block 402 and a valve assembly 405. Responsive to coupling the valve assembly 405 and mixing block 402, valve tray cart 520 may move towards mixing block cart 510 to be positioned adjacent to mixing block cart 510. In embodiments, valve tray cart 520 may be configured to be detachable from mixing block cart 510, such that replacement valve tray carts 520 may be coupled to mixing block cart 510.

Additionally, when valve tray cart 520 moves away from mixing block cart 510, portions of valve tray cart 520 may remain positioned on top of mixing block cart 510, while other portions of valve tray cart 520 may create an overhang. This overhang may enable the replacement of valve assemblies. Subsequently, the overhang may be retracting allowing for the coupling of valve assemblies 405 to mixing block 402.

Figure 7:
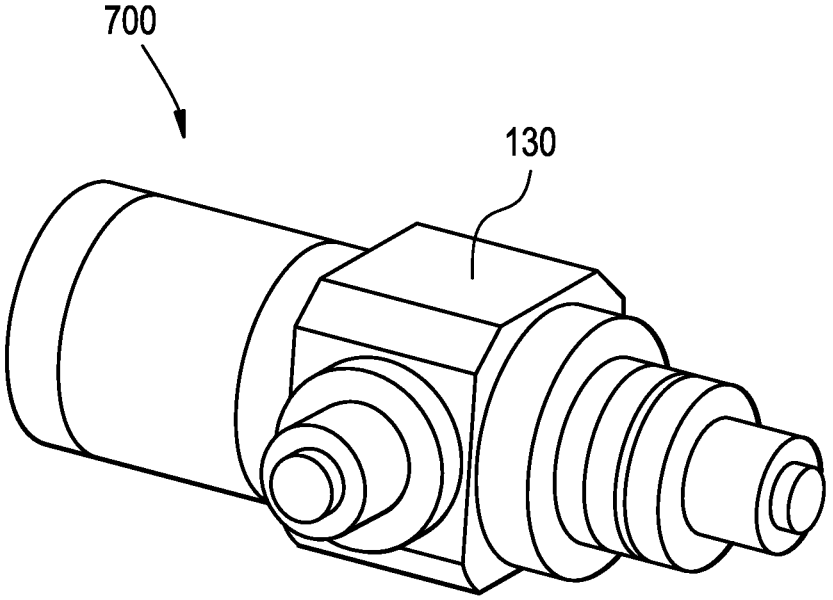
FIGS. 7-8 depict a perspective view of second cart, according to an embodiment.
Figure 7:
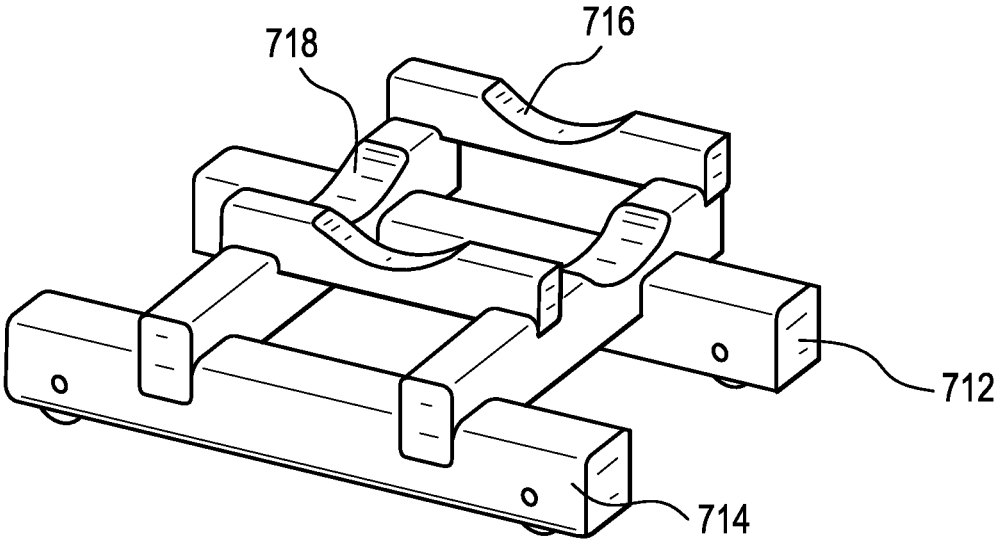
Figure 8:
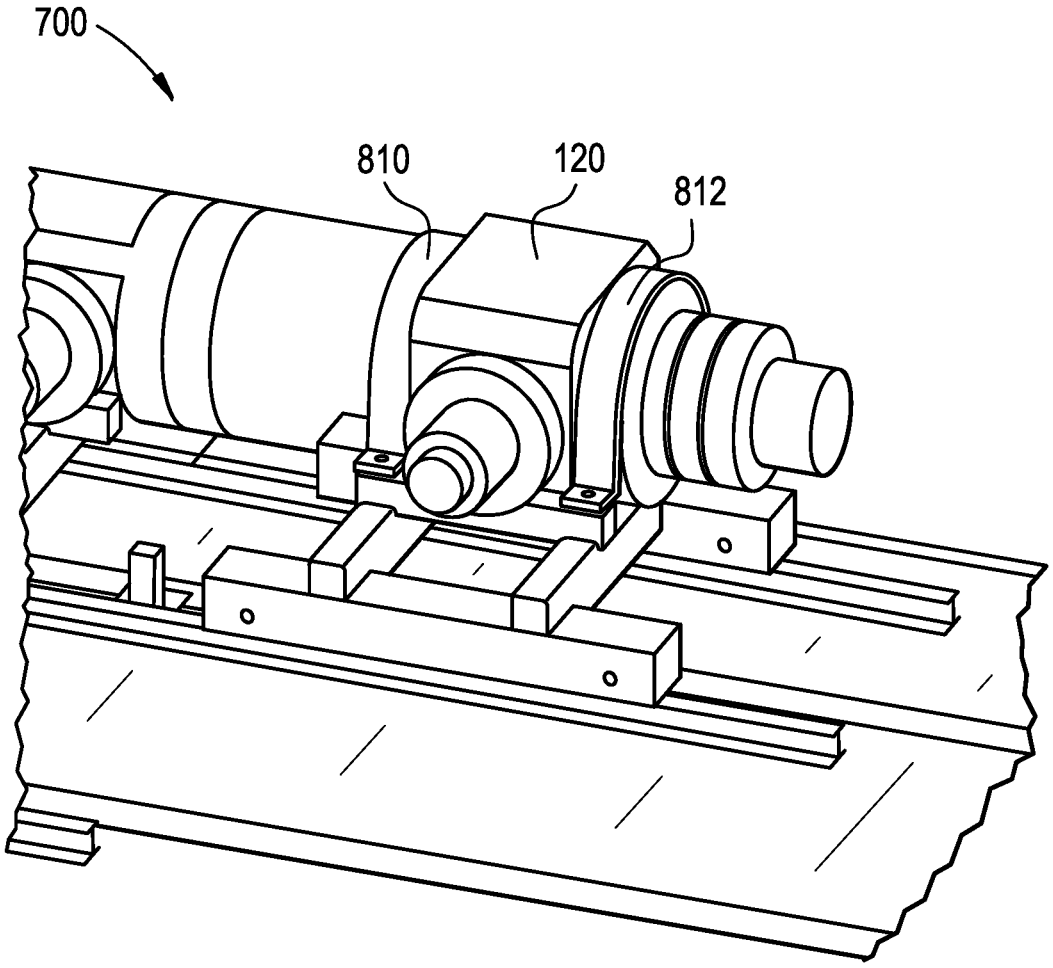

FIGS. 7-8 depict a perspective view of second cart 700, according to an embodiment. Elements depicted in FIGS. 7 and 8 may be described above. For the sake of brevity a further description of these elements is omitted.

Second cart 700 may be configured to hold and secure an injection head module 130 on platform 117, while allowing for the linear movement of injection head module 130. Second cart 700 may include a first support 712, second support 714, and grooves 716, 718.

First support 712 may be configured to be coupled with main rail 210, and second support 714 may be configured to be coupled with lower rail 230 or upper rail 240. By coupling supports 712, 714 to rails, second cart 700 may move along a linear axis.

Grooves 716, 718 may be positioned on upper surfaces of brackets, wherein the grooves 716, 718 are configured to receive injection module 130. Grooves 718 may be configured to injection head module 130 while injection head module 130 is positioned on the second cart 700. In embodiments, first grooves 716 may be positioned in a direction that is perpendicular to second grooves 718.

As depicted in FIG. 8, straps 810, 812 may be positioned over an injection module 130 to further secure injection head module 120 to first cart 700.

Figure 9:
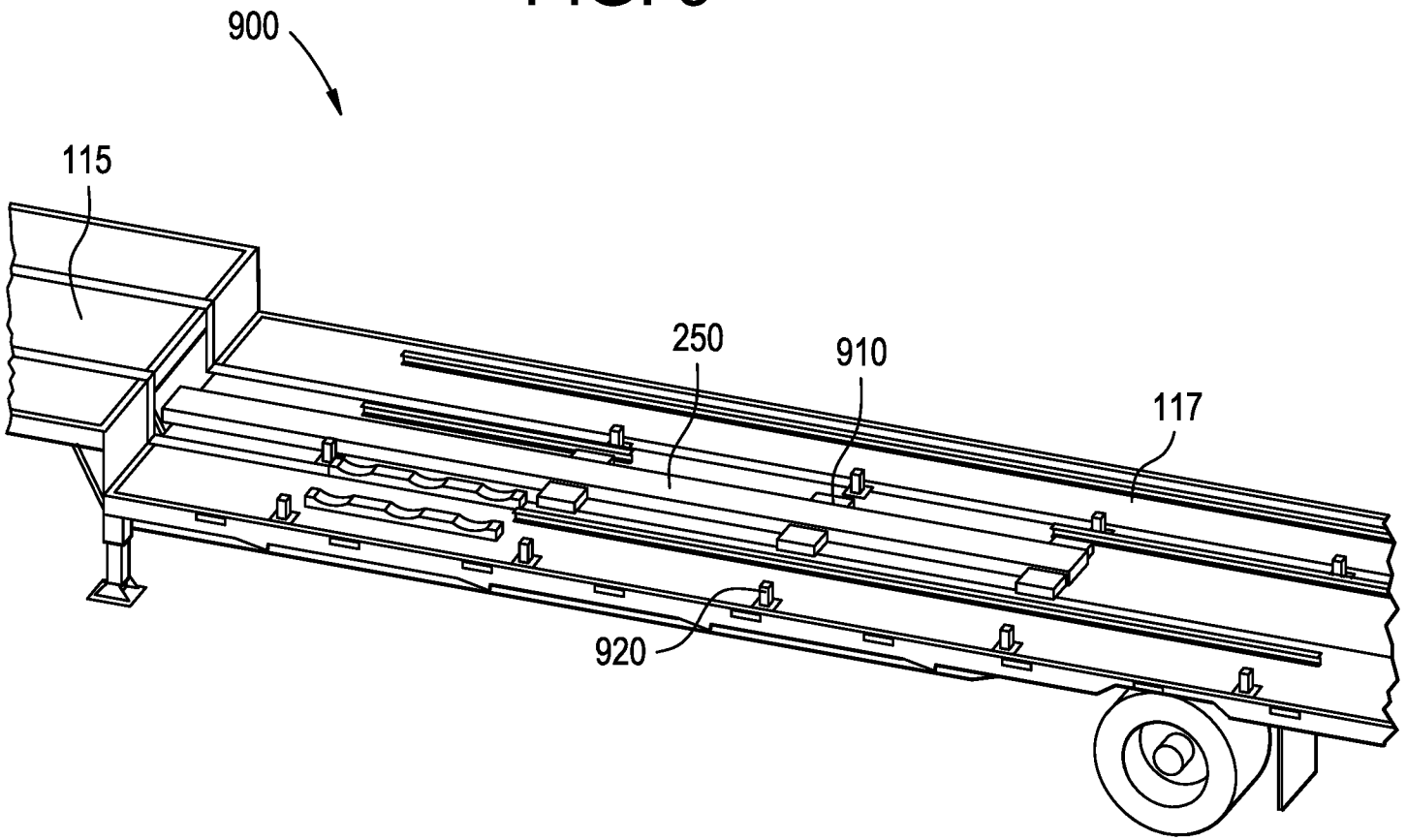
FIG. 9 depicts a system for supporting a decking system, according to an embodiment.

FIG. 9 depicts a system 900 for supporting a decking system, according to an embodiment. Elements depicted in FIG. 9 may be described above, and for the sake of brevity a further description of those items is omitted.

As depicted in FIG. 9, a plurality of quick-connect boards 910 may be coupled with integrated compartment 250. Each of the quick-connect boards 910 may be configured to be positioned under a mixing block module 120. This may enable automation systems to be easily connected and disconnected from a valve or a series of valves without having to recoil wiring through the automation control center. Furthermore, quick-connect boards 910 may be configured to allow a valve to be quickly replaced and coupled with the automation/grease system, as well as allowing entire valve trays to be replaced.

System 900 may also include a plurality of deck supports 920. The deck supports may be configured to couple a mezzanine deck to lower platform 117. In embodiments, deck supports 920 may be spaced apart such that a plurality of valve assemblies may be positioned between the deck supports 920, wherein the deck supports 920 align with the ends of mixing block modules. This may utilize the spacing of the mezzanine deck to provide access to the valve assemblies.

Figure 10:
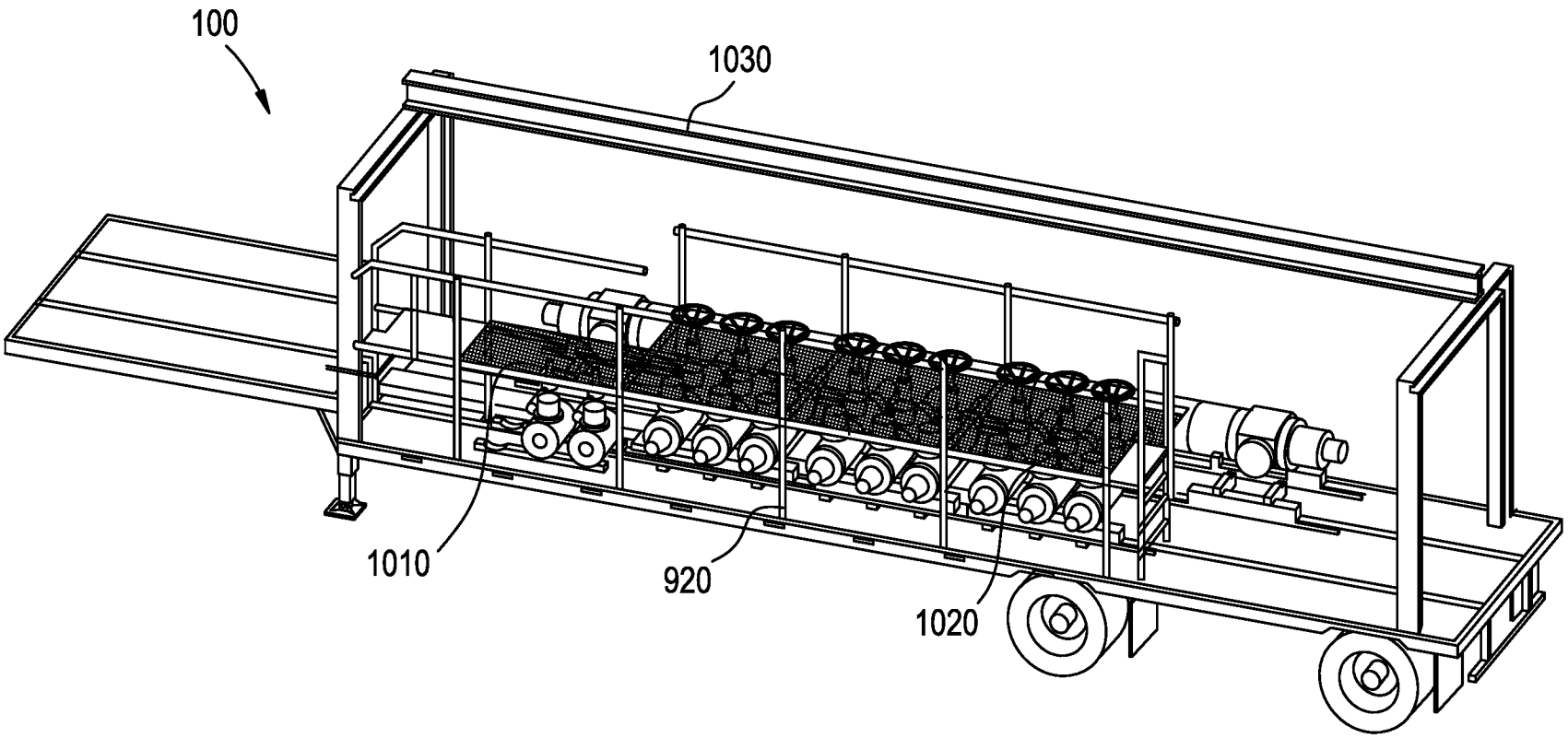
FIG. 10 depicts a system for supporting a deck and a crane system, according to an embodiment.

FIG. 10 depicts a system 1000 for supporting deck 1010 and crane system 1030, according to an embodiment. Elements depicted in FIG. 10 may be described above, and for the sake of brevity a further description of those items is omitted.

Deck 1010 may be configured to couple with deck supports 920 to provide a working floor above the valve assemblies and mixing block modules. Deck 1010 may be configured to be removably coupled to deck supports 920 such that elements of deck 1010 may be removed from trailer 110. Deck 1010 may include panels 1020 that may be configured to be removed from deck 1010, wherein access to the valve assemblies may be available through removed panels 1020. In embodiments, subsections of panels may be removable to expose a single valve assembly.

Crane system 1030 may be configured to be mounted over deck 1010, and extend allowing a length of a trailer. Crane system 1020 may be configured to receive a lifting device that can move along crane system 1030. Responsive to positioning the lifting device over a mixing block module, valve assembly, or injection head module, the lifting device may raise or lower a mixing block module, valve assembly, or injection head module. This may assist in the replacement and/or movements of elements of system 1000 without outside resources.

In embodiments, crane system 1030 may be configured to move on a multiple linear axis. This may enable crane system 1030 to move along a longitudinal and latitudinal axis that is the same as the length and width of the trailer.

Figure 11:
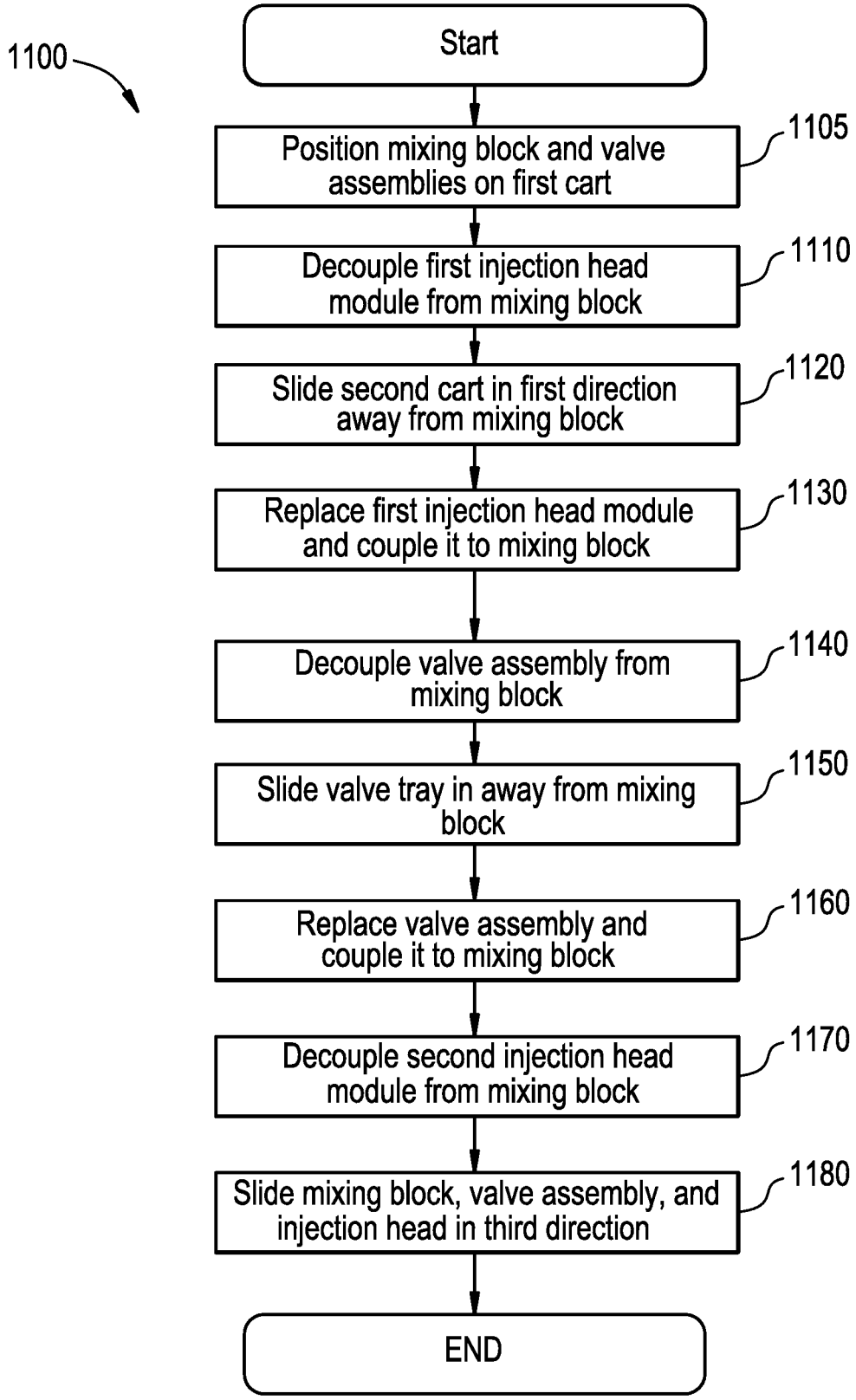
FIG. 11 depicts a method for utilizing rails to move elements of a zipper manifold, according to an embodiment.

FIG. 11 depicts a method 1100 for utilizing rails to move elements of a zipper manifold, according to an embodiment. The operations of method 1100 presented below are intended to be illustrative. In some embodiments, method 1100 may be accomplished with one or more additional operations not described, and/or without one or more of the operations discussed.

Additionally, the order in which the operations of method 1100 are illustrated in FIG. 11 and described below is not intended to be limiting. Furthermore, the operations of method 1100 may be repeated for subsequent valves or zones in a well.

At operation 1105, a mixing block and valve assemblies may be positioned on a first cart. The first cart may be configured to move along rails in a linear direction that is perpendicular to a central axis of a trailer.

At operation 1110, a first injection head module positioned on a second cart that is coupled to rails may be decoupled from a first end of a mixing block.

At operation 1120, the second cart and the injection head may move in a first linear direction along a first set of rails. This may enable the first injection head to be positioned away from.

At operation 1130, a replacement injection head module may be positioned on the first cart, and moved in a second direction and positioned adjacent to the first end of the mixing block, wherein the second direction is an opposite direction than the first direction. Responsive to positioning the replacement injection head module adjacent to the first end of the mixing block, the replacement head module may be coupled to the first end of the mixing block.

At operation 1140, valve assemblies may be decoupled from the mixing block.

At operation 1150, a valve tray on the first cart may extend and move in a direction that is perpendicular to the first direction. Responsive to the valve tray moving, the valve assemblies may correspondingly move in the direction that is perpendicular to the first direction while the mixing block remains stationary. This may separate the valve assemblies from the outputs of the mixing block.

At operation 1160, the valve assemblies may be removed from the valve tray, and replacement valve assemblies may be positioned on the extended valve tray. The valve tray may then be retracted into its original position, such that the replacement valve assemblies are positioned adjacent to the outlets of the mixing block. Then, the replacement valve assemblies may be coupled to the outlets of the mixing block.

At operation 1170, a second injection head module positioned a third cart on a second end of the mixing block may be decoupled from the second end of the mixing block. The decoupled second injection head module may then move in the second direction, away from the second end of the mixing block.

At operation 1180, the mixing block and replacement valve assemblies positioned on the first cart and the replacement first injection head module may move together in the second direction.

To this end, embodiments allow for a modular based system positioned on a single trailer to manage varying job scopes. Elements may be quickly decoupled from each other, and replacement elements may be efficiently coupled to a mixing block.

Figure 12:
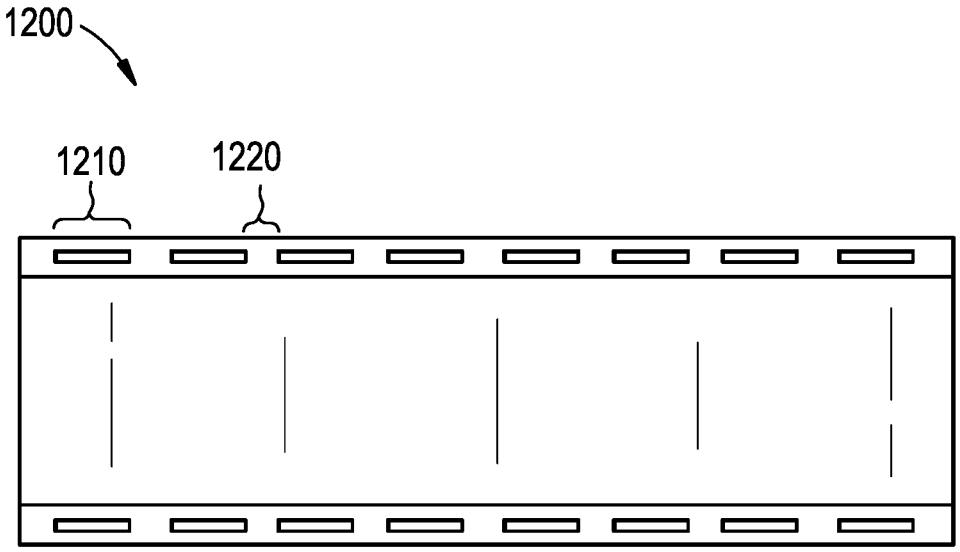
FIG. 12 depicts a mounting system that may be configured to be positioned on a platform, according to an embodiment.

FIG. 12 depicts a mounting system 1200 that may be configured to be positioned on a platform 117, according to an embodiment. Elements depicted in FIG. 12 may be described above, and for the sake of brevity a further description of these elements may be omitted.

Mounting system 1200 may be formed of a substantially rigid material, such as steel, iron, or any other type of metal that can be positioned on a trailer deck. Mounting system 1200 may include a plurality of mounting slots 1210, elongated openings, strut channels, etc. that extend through a thickness of mounting system 1200. Slots 1210 may be configured to be positioned along a length of mounting system from a front edge to a rear edge of mounting system 1200, which may correspond to a length of the bottom trailer deck. In embodiments, slots 1210 may be at least twelve inches long and have a width of at least one and a half inches, wherein a spacing 1220 between slots 1210 may be approximated eight inches. This may enable a bolt of one and a half inches to be positioned through a slot 1210.

Figure 13:
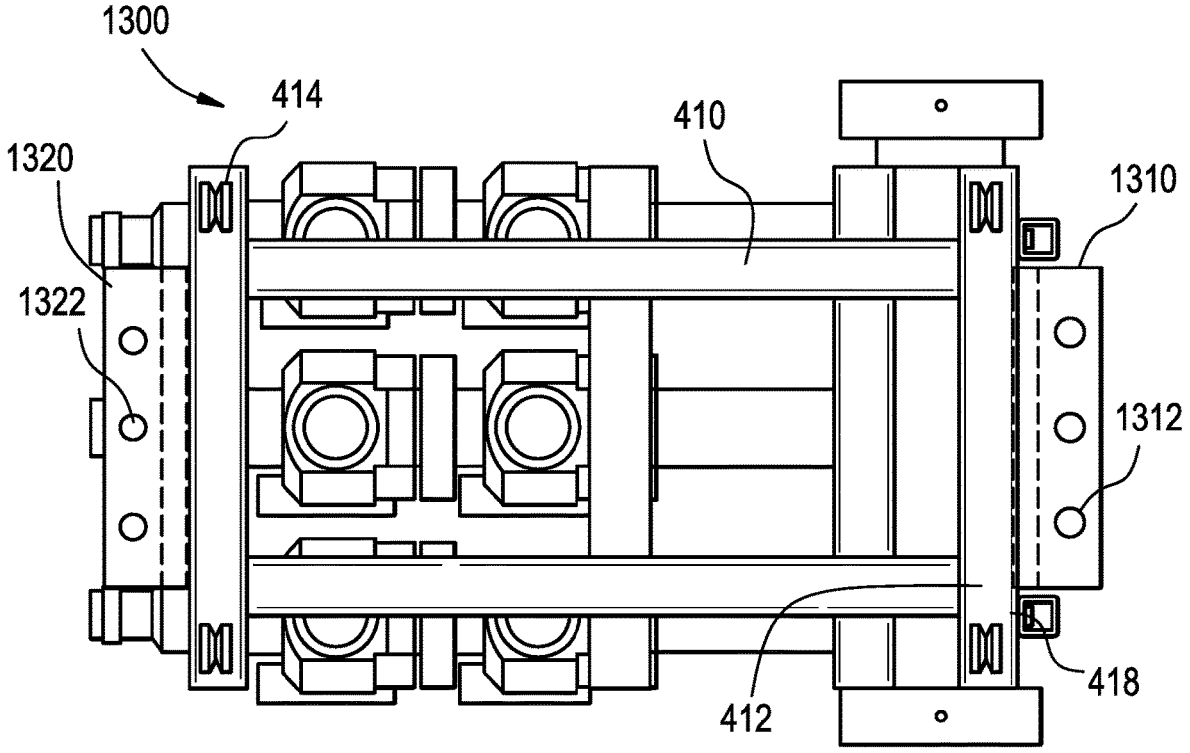
FIG. 13 depicts bottom view of mounting brackets positioned on a first cart, according to an embodiment.
Figure 14:
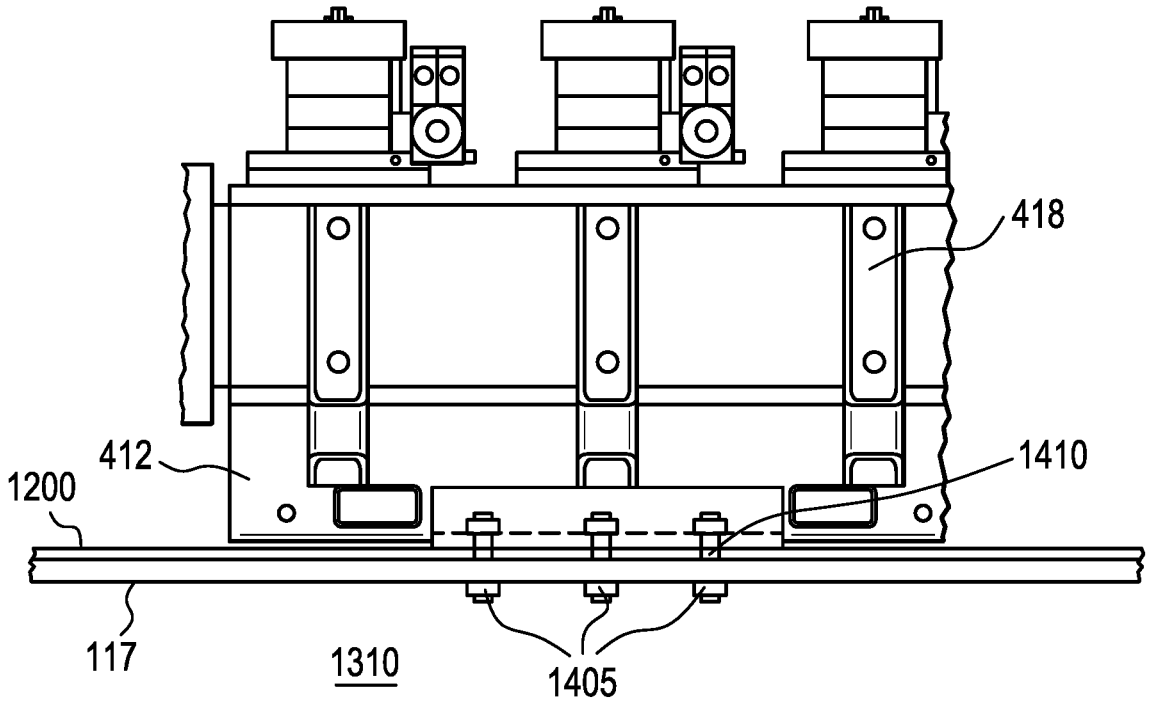
FIG. 14 depicts a rear view of a mounting bracket, according to an embodiment.

FIG. 13 depicts bottom view of mounting brackets 1310, 1320 positioned on first cart 410, according to an embodiment. FIG. 14 depicts a rear view of mounting bracket 1310, according to an embodiment. Elements depicted in FIGS. 13 and 14 may be described above, and for the sake of brevity a further description of these elements may be omitted.

In embodiments, mounting bracket 1310 may be positioned behind first support 412 on first cart 410, and mounting bracket 1320 may be positioned in front of second support 414 on first cart 410. Further, mounting brackets 1310, 1320 may be positioned between the rails on first cart 410, which may enable the coupling of first cart 410 to mounting system 1200 at positions close to a central axis of first cart 410.

Each of the mounting brackets 1310, 1320 may include a plurality of slots 1312, 1322, respectively, that are configured to receive a bolt. Responsive to inserting a first bolt 1405 through a first slot 1210 on mounting system 1200 and slot 1312 and a second bolt 1405 through a second slot 1210 on mounting system and slot 1314, first cart 410 may be coupled to mounting system 1200. Furthermore, a spacer material 1410 may be configured to be positioned between brackets 1310, 1320, mounting system 1200 and platform 117.

Figure 15:
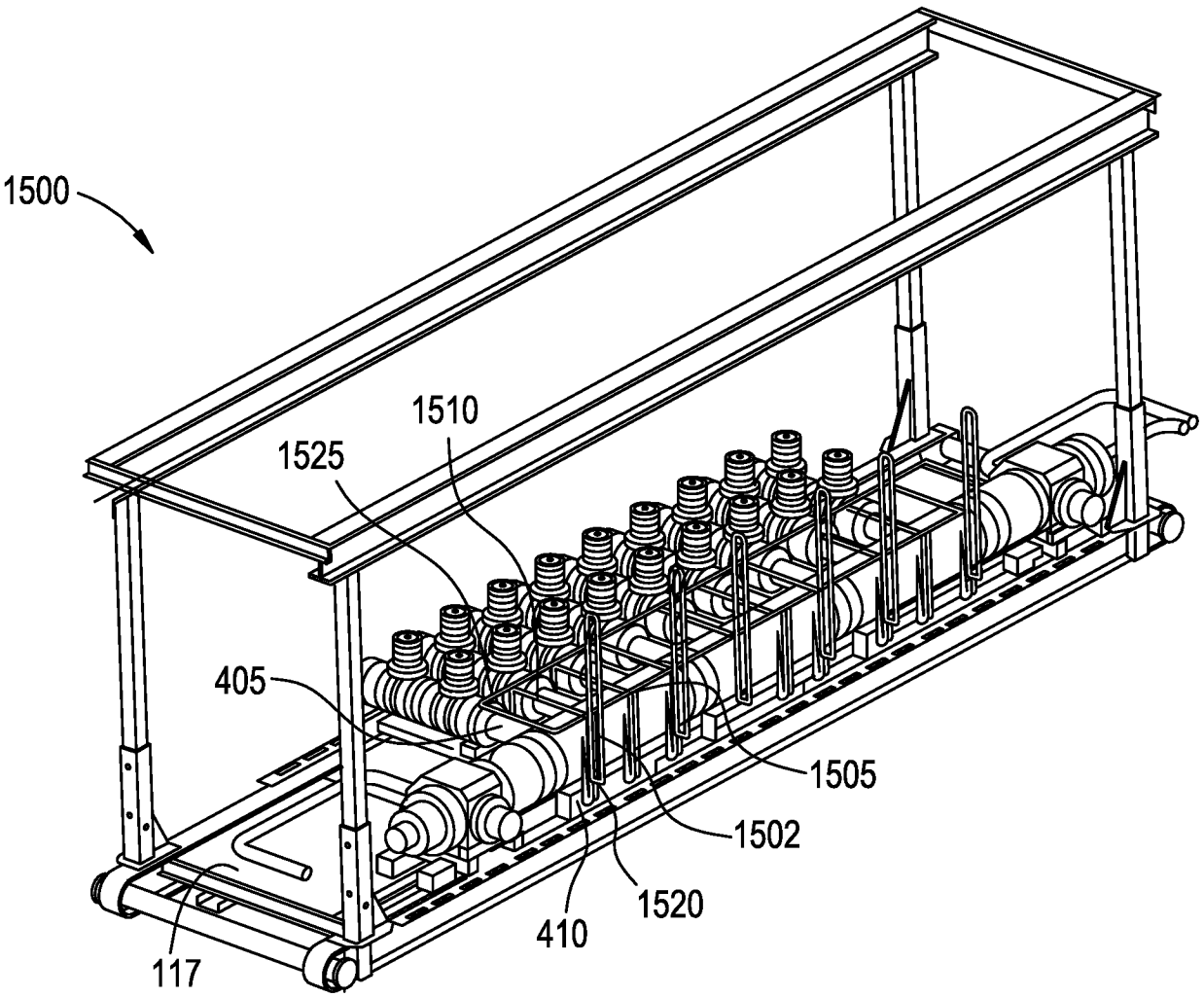
FIGS. 15 and 16 depict an integrated deck frame system, according to an embodiment.
Figure 16:
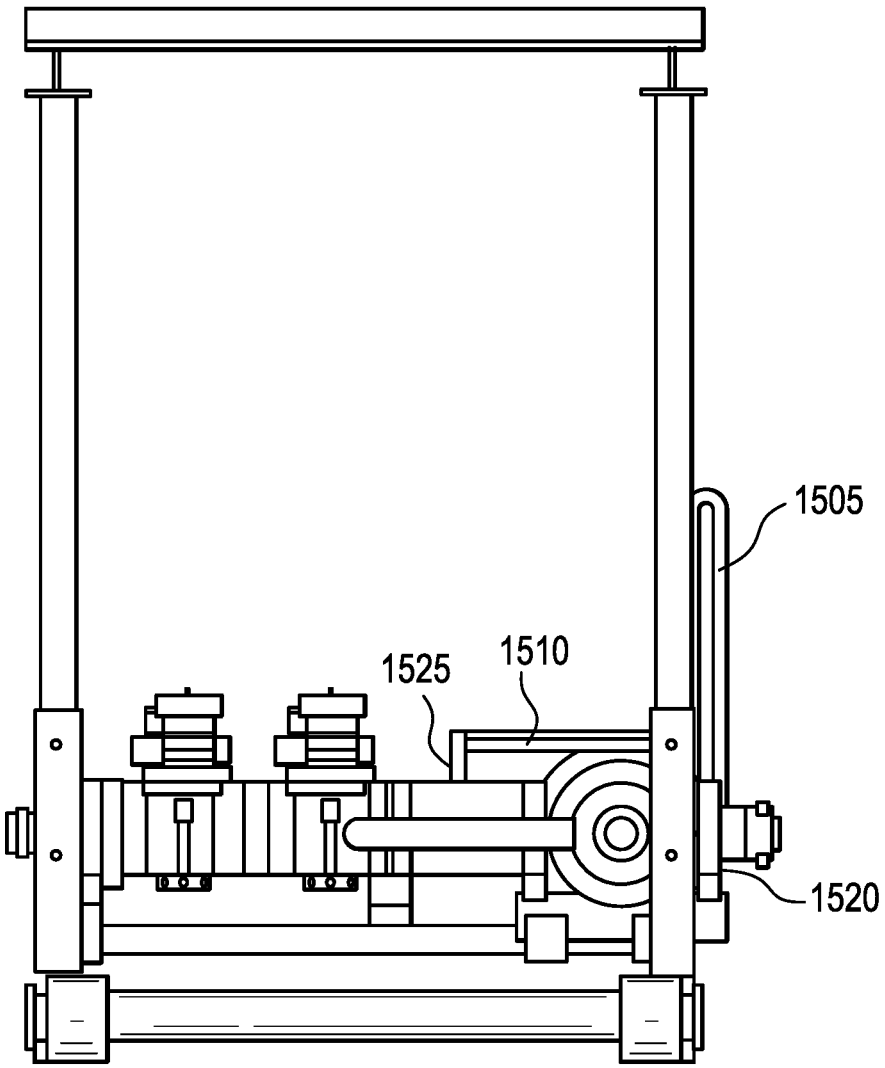

FIGS. 15 and 16 depict an integrated deck frame system 1500, according to an embodiment. Elements depicted in FIGS. 15 and 16 may be described above, and for the sake of brevity a further description of these elements may be omitted.

Deck frame system 1500 may include a plurality of independent rails 1502 that are configured to be coupled with first carts 410 between corresponding valve assembles 405. Each of the rails 1502 may be configured to coupled first cart 410 at multiple locations to form a deck frame, wherein platforms may be positioned and removed from the deck frame. Each of the rails 1502 may include a projection 1505 and support 1510.

Each projection 1505 may be configured to be coupled to first cart 410 at a first location via a pin and a hinge 1520. Responsive to removing the corresponding pin, rail 1502 may be configured to rotate away from first cart 410 allowing access to a corresponding valve assembly 405. Support 1510 may extending from projection 1505 in a plane that is in parallel to a trailer or platform. By utilizing a series of supports 1510, platforms may be positioned on the supports 1510 to form a removable deck over the valve assemblies 405. Each of the supports may have a second end 1525 that is configured to be coupled to a valve assembly 405 or first cart 410 via a clamp 1525.

In embodiments, responsive to securing the clamp 1525 in place and inserting a corresponding pin through hinge 1520, which coupled projection 1505 to first cart 510, support 1510 may form a planar shelf over valve assemblies 405. Responsive to unclamping clamp 1525 and the pin associated with projection 1505, rail 1502 may rotate away from valve assembly 405, such that support 1510 is no longer positioned over valve assembly 405.

Reference throughout this specification to "one embodiment", "an embodiment", "one example" or "an example" means that a particular feature, structure or characteristic described in connection with the embodiment or example is included in at least one embodiment of the present invention. Thus, appearances of the phrases "in one embodiment", "in an embodiment", "one example" or "an example" in various places throughout this specification are not necessarily all referring to the same embodiment or example. Furthermore, the particular features, structures or characteristics may be combined in any suitable combinations and/or sub-combinations in one or more embodiments or examples. In addition, it is appreciated that the figures provided herewith are for explanation purposes to persons ordinarily skilled in the art and that the drawings are not necessarily drawn to scale.

Although the present technology has been described in detail for the purpose of illustration based on what is currently considered to be the most practical and preferred implementations, it is to be understood that such detail is solely for that purpose and that the technology is not limited to the disclosed implementations, but, on the contrary, is intended to cover modifications and equivalent arrangements that are within the spirit and scope of the appended claims. For example, it is to be understood that the present technology contemplates that, to the extent possible, one or more features of any implementation can be combined with one or more features of any other implementation.

The invention claimed is:

1. A system comprising:

a main rail positioned on a first side of a central axis of a platform;

a first rail positioned on a second side of the central axis of the platform, the first rail having a shorter length than the main rail;

a first cart being configured to be coupled with the main rail and the first rail to move along a linear axis in parallel to the first rail and the main rail, the first cart being configured to secure a mixing block and valve assemblies, wherein the first cart includes a mixing block cart and a valve tray, wherein the valve tray is configured to move between an extended and retracted position, wherein the movement of the valve tray is perpendicular to the main rail.

2. The system of claim 1, further comprising:

an upper rail positioned between the main rail and the first rail, wherein the upper end of the upper rail is co-planar with a first end of the main rail.

3. The system of claim 2, further comprising:

a lower rail positioned between the main rail and the first rail in a same axis as the upper rail, a lower end of the lower rail is co-planar with a second end of the main rail.

4. The system of claim 3, wherein a second cart is configured to be coupled to the upper rail and the main rail, and a third cart is configured to be coupled to the lower rail and the main rail.

5. The system of claim 3, wherein the first rail is longer than the upper rail and the lower rail.

6. The system of claim 1, further comprising:

an integrated housing configured to extend along the central axis of the platform between the first rail and the main rail, wherein wiring is configured to be positioned within the integrated housing.

7. The system of claim 1, wherein the first cart includes brackets, the brackets being configured to receive bolts that extend through the brackets and the platform to secure the first cart in place.

8. A system comprising:

a main rail positioned on a first side of a central axis of a platform;

a first rail positioned on a second side of the central axis of the platform, the first rail having a shorter length than the main rail;

a first cart being configured to be coupled with the main rail and the first rail to move along a linear axis in parallel to the first rail and the main rail, the first cart being configured to secure a mixing block and valve assemblies; and a decking system configured to be positioned over the mixing block and the valve assemblies, the decking system including a plurality of removable panels, wherein each of the removable panels may be independently removed.

9. The system of claim 8, wherein the decking system is configured to be rotated away from the mixing block and the valve assemblies.

10. A method for moving a zipper manifold comprising:

positioning a main rail on a first side of a central axis of a platform;

positioning a first rail on a second side of the central axis of the platform, the first rail having a shorter length than the main rail;

coupling a first cart being with the main rail and the first rail;

moving the first cart along a linear axis in parallel to the first rail and the main rail, the first cart being configured to secure a mixing block and valve assemblies, wherein the first cart includes a mixing block cart and a valve tray, and moving the valve tray between an extended and retracted position, wherein the movement of the valve tray is perpendicular to the main rail.

11. The method of claim 10, further comprising:

positioning an upper rail between the main rail and the first rail, wherein the upper end of the upper rail is co-planar with a first end of the main rail.

12. The method of claim 11, further comprising:

a lower rail positioned between the main rail and the first rail in a same axis as the upper rail, wherein a lower end of the lower rail is co-planar with a second end of the main rail.

13. The method of claim 12, wherein a second cart is configured to be coupled to the upper rail and the main rail, and a third cart is configured to be coupled to the lower rail and the main rail.

14. The method of claim 12, wherein the first rail is longer than the upper rail and the lower rail.

15. The method of claim 10, further comprising:

positioning an integrated housing along the central axis of the platform between the first rail and the main rail, wherein wiring is configured to be positioned within the integrated housing.

16. The method of claim 10, further comprising:

positioning a decking system over the mixing block and the valve assemblies, the decking system including a plurality of removable panels, wherein each of the removable panels may be independently removed.

17. The method of claim 10, further comprising:

rotating the decking system away from the mixing block and the valve assemblies.

18. The method of claim 10, wherein the first cart includes brackets, the brackets being configured to receive bolts that extend through the brackets and the platform to secure the first cart in place.

* * * * *